United States Patent [19]

Kramert

[11] 4,449,571

[45] May 22, 1984

[54] HEAT RECOVERY SYSTEM

[76] Inventor: Arthur R. Kramert, 1410 Del Rio Rd., Roseburg, Oreg. 97470

[21] Appl. No.: 321,189

[22] Filed: Nov. 16, 1981

Related U.S. Application Data

[63] Continuation-in-part of Ser. No. 187,091, Aug. 25, 1980, abandoned, which is a continuation-in-part of Ser. No. 17,485, Mar. 5, 1979, abandoned.

[51] Int. Cl.[3] ..... F28F 00/00

[52] U.S. Cl. ..... 165/1; 165/39; 165/70; 165/72; 165/157; 165/DIG. 12; 122/20 B; 126/31; 126/248

[58] Field of Search ..... 165/DIG. 2, DIG. 12, 165/39, 1, 70, 72, 157; 122/20 B; 237/54, 55, 56, 65, 66; 126/93, 94, 31, 248

[56] References Cited

U.S. PATENT DOCUMENTS

| | | | |
|---|---|---|---|
| 4,143,817 | 3/1979 | Oliver | 122/20 B X |
| 4,183,399 | 1/1980 | Seehausen | 165/DIG. 12 |
| 4,222,349 | 9/1980 | Kadan et al. | 122/20 B |
| 4,286,975 | 9/1981 | Whiteley | 165/DIG. 2 X |

FOREIGN PATENT DOCUMENTS

| | | | |
|---|---|---|---|
| 2747620 | 4/1979 | Fed. Rep. of Germany | 165/29 |
| 2901690 | 10/1979 | Fed. Rep. of Germany . | |
| 2823977 | 12/1979 | Fed. Rep. of Germany | 165/DIG. 12 |
| 2935543 | 3/1981 | Fed. Rep. of Germany . | |
| 2297382 | 8/1976 | France | 122/20 B |

*Primary Examiner*—Samuel Scott
*Assistant Examiner*—Margaret A. Focarino

[57] ABSTRACT

This invention relates to method and apparatus used as an addition to any existing heating system—burning any fuel—for heat recovery from stacks and chimneys. It uses a suitable heat exchanger mounted at the *apex* of such stacks, by virtue of which location no natural draft is lost. The system includes a circulating pump, a thermostat, an expansion bottle, a condensate trough, a cap and dome which jointly serve to act as unloaders to protect the system liquid from being boiled off. Both sensible heat and the latent heats of moisture in the fuel and in the vapor produced as a combustion product, can be scrubbed out. The use is to effect economies and to reduce environmental contamination wherever fuels are fired.

1 Claim, 1 Drawing Figure

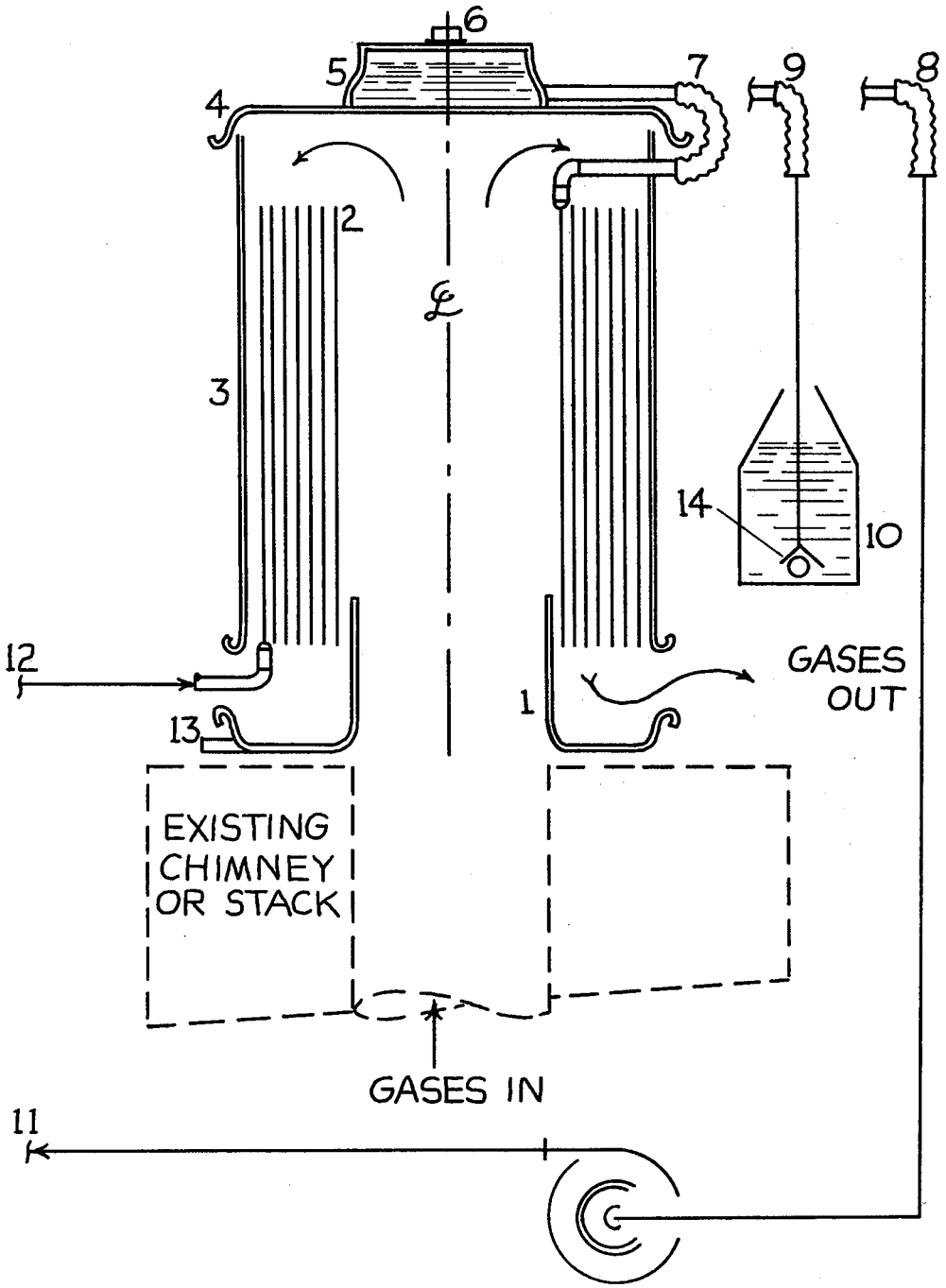
6
5
7
9
8
4
2
3
14
10
12
13
1
GASES
OUT
EXISTING
CHIMNEY
OR STACK
GASES IN
11

HEAT RECOVERY SYSTEM

This application is a continuation-in-part of application Ser. No. 187,091 filed Aug. 25, 1980, now abandoned which was itself a continuation-in-part of application Ser. No. 017,485 with a filing date of Mar. 5, 1979 and now abandoned; all of the same title.

BACKGROUND OF THE INVENTION

This invention is a method for the recovery of waste heat from smokepipes, chimneys or stacks using natural draft. All the prior art known to me suffers from the natural limitation that only a fraction of the stack heat can be recovered lest the natural draft be hopelessly impaired. Countless arrangements have been devised to nibble away some of that heat but all have been remiss in identifying the nature of the problem and have been accepting stack heat losses as an inevitable price to pay for draft—when actually we can regain it all.

SUMMARY OF THE INVENTION

The heart of my invention lies in two considerations:

A. To optimize heat recovery the gases should be cooled down enough to condense out the moisture and so surrender the latent heat of vaporization. This requires exit gas temperatures of 205° F. and less.

B. With such gas temperatures, no stack or chimney would function unless monstrously tall. Therefore the key is to scrub the heat out at the *apex* of the stack where the gases are dumped while the vertical run of gases below remains hot and the draft is unimpaired. This is a new result, not confined to any one fuel and not limited to any specific appliance. It is used in series with existing equipment not in lieu of it.

My invention employs a suitable heat exchanger mounted on a stack or chimney and so baffled that the gases go up thru the core and down thru the exchanger before release to the atmosphere. The condensables are in parallel flow with the gases and contribute to the exchange efficiency by virtue of the dropwise condensation. The shrink in volume before discharge actually augments draft. The exchanger delivers heated water which can be: used to supplement an existing heating system, or serve conventional heating appliances located where desired, or used in radiant heating floors or ceilings, simply stored, used to heat domestic water, or whatever.

BRIEF DESCRIPTION OF THE DRAWING

The drawing shows a vertical section thru the exchanger and housing and a schematic of the other elements. The exchanger unit either sits on top of a leveled masonry chimney or is supported to embrace a stack. The exchanger shown is in the form of a spiral scroll which provides large area in compact form and is readily removed for cleaning the surfaces. The basic elements are a torus shaped condensate pan (1); the exchanger scroll (2); a jacket around the scroll (3); a hinged cap (4) which is tensioned to open by a spring; the cap incorporates a dome (5) and a filler cap (6); short flexible hoses lead from the exchanger outlet (7) and from the dome (5) down to piping which leads to a pump; hose (9) runs to tubing which leads to expansion bottle (10). Connection (13) is a stub tube inserted low in pan (1) so that condensate may be drained off as required.

The pump circulates heated water to any conventional system or device or to a hot water storage tank as is often employed with solar heating systems, via supply line (11) and return (12).

DETAILED DESCRIPTION

The construction of the condensate pan (1), the cap (4), and the dome (5) are obviously made by conventional spinning or stamping methods as elected for the volume of manufacture contemplated.

In the interests of clarity and simplicity, minor elements of construction are not shown on the drawing when they can be conveyed by description, which follows:

A weatherproof, snap-acting thermostat, set for 140° F. is surface mounted on the exterior of the jacket—anywhere close under the cap—preferably near the hinge. This is to start and stop the pump when a manual/automatic switch is in the automatic position.

The dome (5) has three functions: it is an air separation chamber where air swept out from anywhere in the whole heating system would collect; it has a minor superheating effect; it is an unloader independent of external power, to prevent boiling off liquid if the power supply were to be interrupted or the usage point could not absorb as much heat as was produced. If steaming occurs, the liquid in the dome is forced out via hose (9) to small diameter tubing which runs to nearby expansion bottle (10) thru check valve (14) which has a controlled leak in the reverse direction. When vapor condenses in the dome, it allows the return of liquid over a period of say half an hour to overcome the spring and close the cap and test again for excessive heat. Incidentally, the cap in an open position without any firing going on, serves as a signal of air in the system to be bled out.

The tubes which project from the dome and to which the hoses connect, extend out over the hinge area and are given support at the outboard end to withstand shipping abuse.

The liquid in the system can well be clean, filtered rain water, with only enough ethylene glycol antifreeze added to protect against minimum temperatures. This does not preclude other precautions against freezing which can be used.

The pump of choice selected for prototype models may be of interest. It is not universally known that small centrifugals are available with magnetically coupled drives which eliminates weeps from stuffing boxes or mechanical seals as might develop over years of service. Such pumps also protect themselves in that the impeller declutches should grit from a dirty piping system be entrained.

While any conventional heating device can be supplied it is worthy of note that where radiant heating systems are contemplated, the use therein of liquid temperatures lower than usual and the consequent spread in the driving force (delta T) between the gases and the liquid makes the heat recovery potential even greater than in a normal system. Oversizing of unit heaters, convectors, coils, etc. which lowers the temperature requirements of the circulated water for the same heat output, has a similar benefit.

DEFINITION OF SUITABLE HEAT EXCHANGER

The salient parameters of: configuration, material and method of usage will be reviewed in order that old, existing exchangers may better be evaluated for their "suitability" and lend meaning to that word.

When the driving force, the spread between source and sink, the delta T, is high, the requisite area for the transfer of a given quantity of heat is low. As the delta T is reduced the area required increases directly; but if we are crafty and use all the methods at our disposal—a phenomenon can be exploited. When the gases are cooled enough to initiate condensation they not only surrender their sensible superheat and latent heats, but the condensables form droplets that trickle down a vertical surface and the overall coefficient jumps up. Thus a further reduction in delta T does not require the brutal use of still more area because overall transfer is so greatly augmented. The condensables are there in the gases. Air dry wood has 25% moisture by weight; oil and natural gas burn to produce 1.1 pounds and over 2 pounds of water vapor respectively, per pound of fuel fired.

The exchanger surfaces must be directly in the gas stream; the benefits are more than a trade-off for the possible fouling and corrosion problems which may need to be faced.

Contrary to visceral instinct, the gases should not be slowed down and given longer residence time in the exchanger. It is beyond the scope to here examine the effects of velocity and inert gases—suffice it to say that gas expansions and contractions should be held to a minimum and the free area for gas flow through the exchanger should be in the order of 1.15 times the stack area.

By-pass factor should be low, slice up gases, get good approach to liquid side temperatures. Manufacturers already have their standard constructions rated.

Any finned tubes should have the fins vertically disposed to provide no shelves for soot, etc.

Where "exotic" metals are selected, their inferiority to copper or aluminum in conductivity militates against finned tube construction in that the travel distance penalizes efficiency.

Configurations which place surfaces in vertical planes to allow long dropwise travel are highly desireable.

Configurations must not evade the problem of access to surfaces so that ultimate fouling can be cleaned.

In hostile environments (where oil and wood are being burned) dissimilar metals or brazed joints are vulnerable to accelerated galvanic corrosion. Minimum separation in the electrochemical series is indicated.

The exchanger used in a residence should be compact and light so that, say, bi-annual cleaning by the owner is neither infeasible nor a repellant task.

Standard constructions or simplicity result in fabrication economies, lower end-product cost, and so become available to the poorest of us who comprise a market segment which needs it most.

In isolated industrial applications, a suitable heat exchanger may be of direct-contact type using sprays, trays or packing. This practice suggests itself where contamination of a refluxed liquid by the gases is negligible, or can be returned to process, or can be continuously blown down.

For clarity—I do not file any claims in this application for the structure of the heat exchanger but give criteria to be used in selecting and applying existing exchangers in a method for achieving the results which I do claim, I have designed an exchanger specifically for this use, covered by a separate co-pending patent application titled "Heat Exchanger" Ser. No. 074,020 incorporated herein by reference.

I claim as my invention:

1. A method for recovery of wasteheat from any source by placing a gas to liquid exchanger atop a chimney or stack within a housing providing for routing all the gases through the exchanger which has the requisite area, all its surfaces directly in the gas stream and low by-pass factor to maximize approach; extracting all the latent heats in the condensibles; and orienting the surface so that wetting by the condensates is exploited to further enhance the total heat transfer;

wherein the improvement lies in locating such an efficient exchanger at the apex of a chimney or stack so that the entire column of gases below remains hot and—thus without loss of natural draft—recovery of heat is constrained only by the temperature level of the liquid side.

* * * * *